United States Patent [19]

Normand et al.

[11] Patent Number: 4,951,950

[45] Date of Patent: Aug. 28, 1990

[54] MANUAL PLAYING CARD DEALING APPLIANCE FOR THE PRODUCTION OF PROGRAMMED DEALS

[75] Inventors: Gérard Normand, Besancon; Michel Persuy, Le Vesinet, both of France

[73] Assignee: Acticiel S.A., France

[21] Appl. No.: 250,882

[22] Filed: Sep. 29, 1988

[30] Foreign Application Priority Data

Oct. 2, 1987 [FR] France ..... 87 13650

[51] Int. Cl.[5] ..... A63F 1/14

[52] U.S. Cl. ..... 273/149 P; 273/149 R

[58] Field of Search ..... 273/149 R, 149 P

[56] References Cited

U.S. PATENT DOCUMENTS

| | | | |
|---|---|---|---|
| 1,824,542 | 9/1931 | Hangerud | 273/149 R |
| 2,065,824 | 12/1936 | Plass | 273/149 R |
| 2,581,247 | 1/1952 | Florant | 273/149 R |
| 3,222,071 | 12/1965 | Lang | 273/149 P |
| 3,489,907 | 1/1970 | Kenez | 273/149 P |
| 3,658,342 | 4/1972 | Boren | 273/149 P |
| 3,731,936 | 5/1973 | Copeland | 273/149 P |
| 3,743,294 | 7/1973 | Forster | 273/149 P |
| 4,534,562 | 8/1985 | Cuff et al. | 273/149 P |
| 4,662,637 | 5/1987 | Pfeiffer | 273/149 P |
| 4,822,050 | 4/1989 | Normand et al. | 273/149 P |

FOREIGN PATENT DOCUMENTS

| | | | |
|---|---|---|---|
| 0233829 | 8/1987 | European Pat. Off. | 273/149 P |
| 2540737 | 8/1984 | France | 273/149 P |
| 2571269 | 4/1986 | France | 273/149 P |
| 2576518 | 8/1986 | France | 273/149 P |

*Primary Examiner*—Edward M. Coven
*Assistant Examiner*—Jessica J. Harrison
*Attorney, Agent, or Firm*—William A. Drucker

[57] ABSTRACT

The device comprises a box receiving the deck of cards to be dealt, upon which a cover presses. Rollers, driven in rotation by a motor reduction unit ensures partial exit of the lower card of the stack to a slot in the device whereas optical reading means read a value code marked on the card. When the value of the card read comes close to the information contained in the memory relative to the deal being made, a visual display device indicates to which player the card pushed out of the deck and partially protruding should be dealt.

7 Claims, 4 Drawing Sheets

MANUAL PLAYING CARD DEALING APPLIANCE FOR THE PRODUCTION OF PROGRAMMED DEALS

BACKGROUND OF THE INVENTION

1. Field of the Invention

The invention concerns a playing card dealing device and more specifically, such a device for dealing programmed deals to players without them being aware of the content of the deal.

2. Description of Prior Art

French patent number 86.03161 (published under number 2 595 259), refers to encoded cards with, in two opposite corners, a reading book including a code on four lines and three or four columns as well as an automatic dealing device for such cards. By the movement of the carriage, this appliance will dispense cards into cases with deals programmed by the appliance itself or by any system such as a serving center, coded cards or a PC computer. A device such as this, reliable in its operation, has however a drawback of being relatively costly for an individual user who simply wishes to organize within his premises one or several game tables.

SUMMARY OF THE INVENTION

The purpose of this invention is to remedy this drawback and it proposes, a manual card dispenser which although being easy to manufacture and of a low cost price, will dispense programmed deals by any facility whatsoever.

The dispensing appliance according to the invention includes a case with a recess accommodating the deck of cards to be distributed, a device reading the codes marked on each card, a memory in which the deals to be made are stored, a display system indicating the position of the player for whom the card is intended by the comparison of information read on said card with information contained in the programmed deal, and means of driving the card to ensure its partial exit from the appliance so that it may be grasped by the user and dealt manually to the player whose position is indicated by the device.

The device according to the invention is particularly useful for the distribution of playing cards with in two opposite corners a code on four lines and three or four columns as proposed by French patent number 86.03161 mentioned above. The optical reading device which scans the encoded information marked on the playing cards can also be used to good advantage to read an encoded band with four tracks, including one synchronized track, making it possible to enter into the memory of the device simple deals or commented details and the circulation of this tape through the unit is ensured by the card driving device.

The display device carried by the unit can be of any suitable type using liquid crystals, diodes, pointers or flaps for instance and indicates one of the four cardinal points corresponding to the players. To improve this display, numerical digits may be associated to include the number of the deal being made. Permutation of the display device makes it possible to change dealers without changing the orientations of the table as defined initially.

It is to good advantage to associate the dispensing device according to the invention with a microprocessor with or without an auxiliary memory to ensure the management of the distribution and allow interfacing, not only with the distributing device but also with a printer, a minitel or a PC computer. A management microprocessor such as this will feed the deals to several card dispensing devices.

BRIEF DESCRIPTION OF THE DRAWINGS

To clearly understand the device according to this invention there follows, not in a limitative manner, a design with reference to the schematic illustration attached hereto in which.

DESCRIPTION OF THE PEFERRED EMBODIMENT

Figure 1:
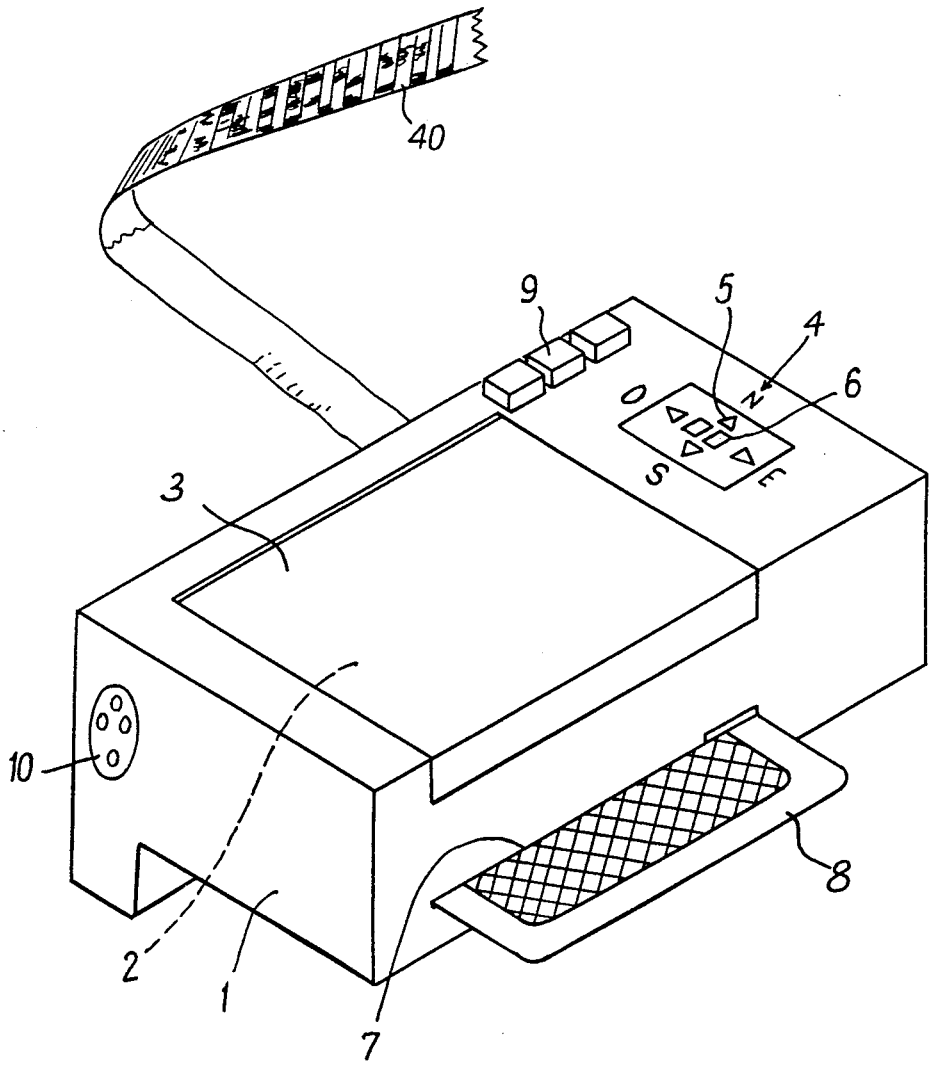
FIG. 1 is a prospective view of the playing card distributing device according to the invention.
Figure 2:
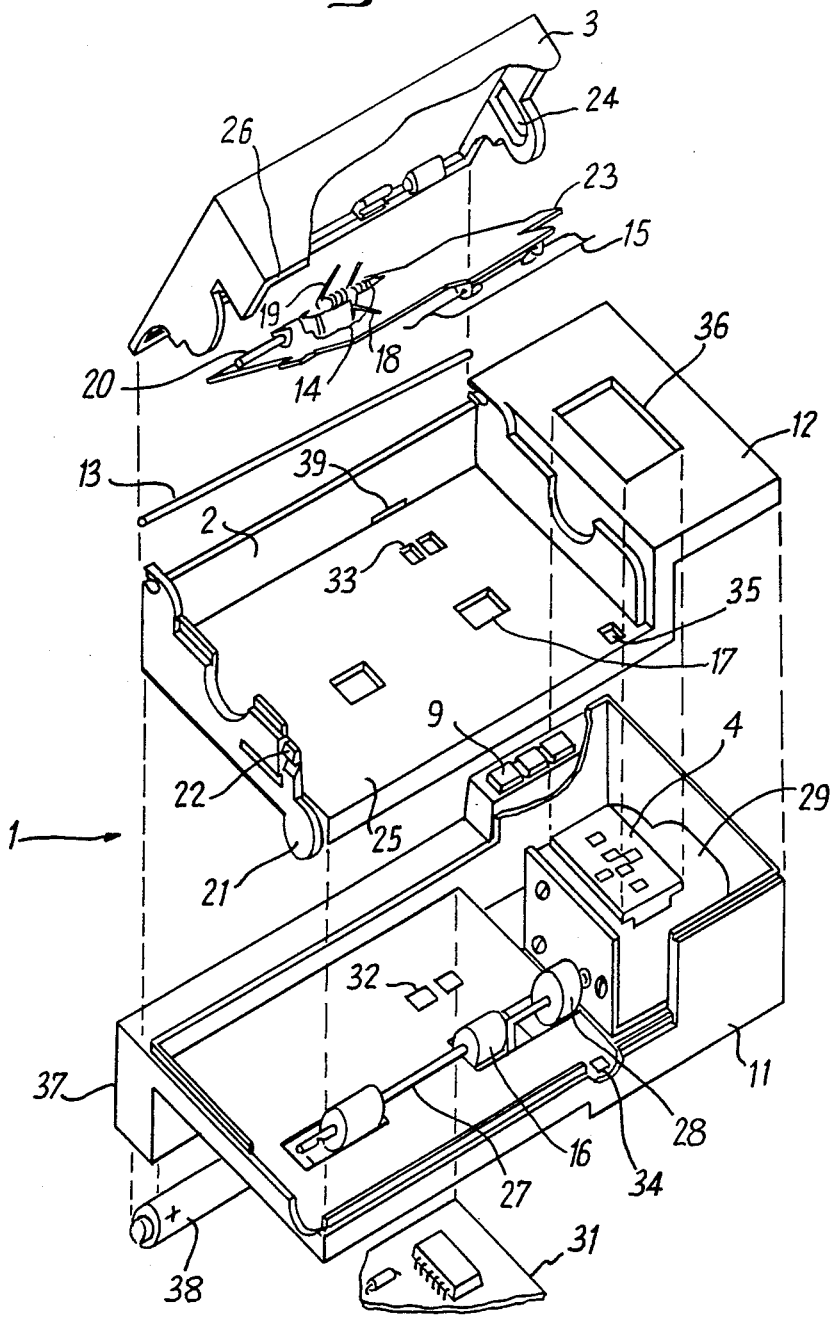
FIG. 2 is an exploded perspective view, with cutaways, of the device of FIG. 1.

With reference to FIGS. 1 and 2, 1 shows the distributing device in the form of a rectangular box with a housing 2 in the form of a shoe sized according to a deck of cards and closed by a hinged cover 3. Alongside shoe 2 box 1 comprises display 4 for associating, with each of the four cardinal points symbolizing the players, an indicator lamp 5 comprising a diode. At the center display 4 includes a liquid crystal device 6 displaying a deal number.

On the side as an extension to shoe 2 box 1 has slot 7 for the successive exit of the playing cards 8. Near display 4 box 1 includes key set 9 which, as will be explained further, controls certain functions such as: presentation of first card after insertion of the deck of cards to be dealt into the shoe, scrolling forward and backward of the deal numbers, callback of the display of the last card withdrawn etc. In addition, connector 10 makes it possible to connect the dealing device to a serial or parallel source of information and if necessary to a power outlet for direct supply or for battery recharging purposes.

In reference more specifically to FIG. 2, box 1 of the device comprises shell 11 closed by front 12 including shoe 2. On the rear edge of front 12 is mounted cover 3 swiveling on pin 13. On inner face cover 12 hinges flap 14 on which is mounted bar 15 which, when cover 3 is closed, bears against the deck of cards placed in shoe 2, near the rubber dry roller 16 which cooperate with the lower card of the deck through windows 17 of front 12. Spring 18 placed between flap 14 and cover 3, when said cover is closed, conveys force to the cards in the deck via beam 15. Another spring 19 integral with the same shaft 20 as spring 18 is placed between cover 3 and front 12 to permit the cover to be opened.

On the side of front 12 there is a flexible knob 21 integral with hook 22 designed when idle to fit into a slot (not shown in drawing) supported on the inside by cover 3. It can be understood that with cover 3 in its closed position as shown in FIG. 1, action on knob 21 will release hook 22 from the corresponding slot by releasing cover 3. Both springs 18 and 19 jointly raise cover 3 until pins 23 of flap 14, while moving through side holes 24 in cover 3, abut at the end of these holes. Then only spring 19 raises cover 3 to a position allowing a deck of cards to be inserted in shoe 2. To form slot 7, as visible in FIG. 1 and allowing the withdrawal of the cards one by one, a clearance is provided between front lip 25 of front 12 and lower edge 26 of cover 3.

Drive roller 16 mentioned above are mounted on shaft 27 and are driven through a freewheel 28, by a DC motor reduction unit 29, housed in shell 11. Motive power is provided by freewheel 28 when motor 29 causes card 8 to advance through slot 7 and it is freed when the operator manually withdraws the card thus preventing the driver of reducer 29 which could be irreversible.

An optical encoder (not shown in the drawing) controls motor 29 in order to cause the shaft 27 to rotate, corresponding to the protrusion of card 8 one third to one half of its width.

Figure 4:
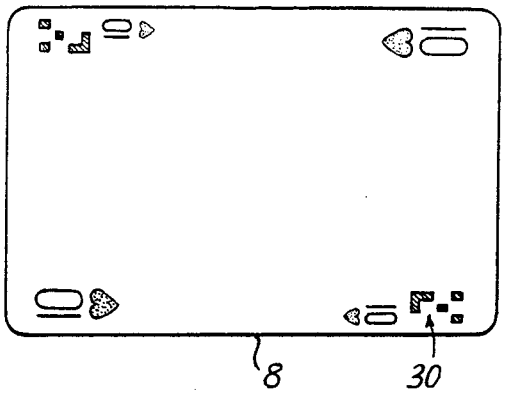
FIG. 4 is a plan view of a playing card with an optical reading encoding system which can be used with the device according to the invention.

The playing cards used with the distributing device according to the invention are the type described in application for French patent number 86.03161 ie., (see FIG. 4) they each comprise at the top right and bottom left a reading block 30 comprising a code on four lines and three columns. An electronic card 31 placed at the bottom of shell 11 bears in one of its corners, corresponding to the corner of the playing card with a reading block 30, four detectors 32 which via windows 33 in the base of shoe 2 read the code of the bottom card of the deck. These detectors 32 can comprise photo emitter-receiver couples operating by reflection and windows 33 can include the diagrams and collimators of the reading optics.

Another photo receiver 34 placed opposite a window 35 near the front edge 25 of front 12 will detect complete exit of card 8 to automatically control partial ejection of the next card.

Display device 4 mounted on an independent printed circuit connected to the main electronic card 31 by means which are not illustrated, through window 36 in front 12, gives a display of the dealing instructions. Alphanumeric digits can be provided at the four cardinal points in order to have them turn according to the dealers.

Key set 9 supported by shell 11 as indicated above, controls the distributer functions. This key set is connected to the main electronic card 31 which includes a memory.

At the rear of shell 11 is an opening 37 housing electric batteries of rechargeable batteries 38 powering the different functions of the distributer. A cover (not shown) locks the batteries into this opening which also forms a grip providing an ergonomic handle for the case while the thumb controls the keys of key set 9.

In an extension to windows 33, fron 12 has a slot 39 at the rear through which the encoding band shown in 40 of FIG. 1 can be inserted. Band 40 is driven by roller 16 by the continuous rotation of motor 29 through the depressing of a special key on keyset 9 causing it to move in front of readers 32 and exit via slot 7 while being pressed down correctly on roller 16 by part of beam 15. Encoding band 40 can carry deals, corrected deals or the results of a game which can thus be entered directly into the distributing machine memory.

The method of using the ditributing device is then as follows. The user inserts a programmed band 40 into the device and loads into memory, for instance, 16, 32 or 48 deals. He then takes the device to the games table, opens shoe 2, inserts a deck of cards and closes the shoe by locking cover 3 with hook 22. The user then controls partial extension of first card 8 through slot 7 by operating the appropriate key of keyset 9. Then, with his free hand, he grasps the card thus presented to deal it to the player whose position corresponds to the cardinal point indicated by indicator lamp 5. As already mentioned, the exit of card 8 when distributed, automatically controls through photo receiver 34 the presentation of the next card of the deck.

Once the game is over, the user can indicate on a pre-encoded band, by simple encoding with a line, the results of the game opposite the dealer number. He can then put the deck of cards back into the device and move on to distribute the next deal or hand the distributing device on to the next dealer.

Figure 3:
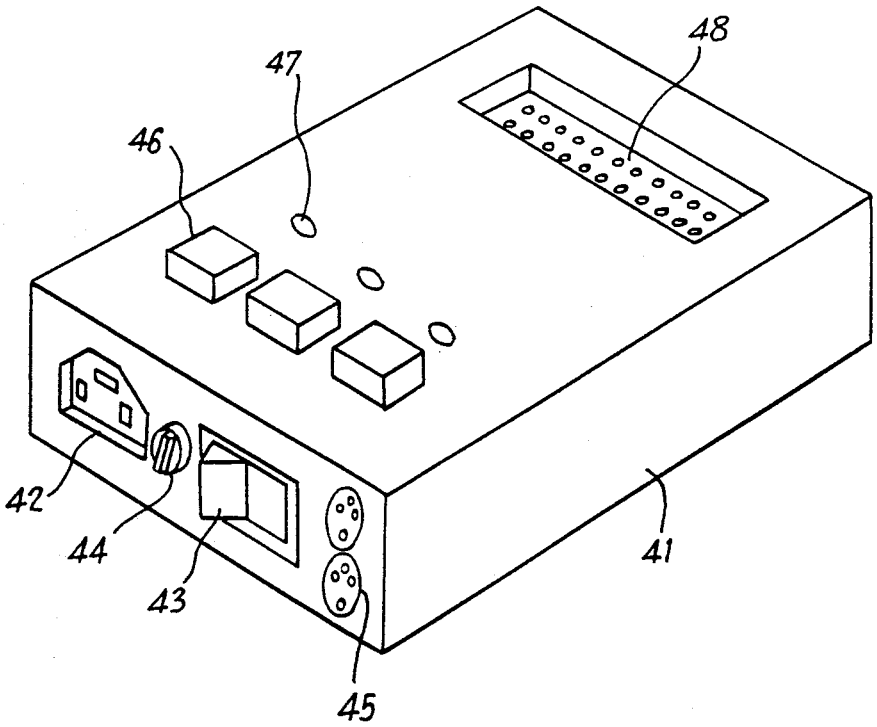
FIG. 3 is a prospective view of a control microprocessor which can be connected to the distributing device of FIGS. 1 and 2.

Advantageously but not mandatorily, the distributing device according to the invention can be associated with a deal management microprocessor. A management microprocessor such as this, a well known item as such, is shown in FIG. 3 in the form of rectangular box 41 and includes:

- a connector for plugging into the mains voltage 42 with switch 43 and fuse 44;
- plugs 45 for connection to different terminals (such as a minitel, card distributor, printer, PC computer, disk drive, auxiliary memory);
- a keyset 46 controlling the display of a variety of operations such as initialization, stop function, battery recharge, etc.
- diodes 47 indicating that a function is emulated.

The microprocessor will manage the functions of the game and is capable of creating deals and loading them into the card distributing devices. A connector 48 makes it possible to add an auxiliary memory (not shown) to save deal corrections and provide their display on a monitor capable of communicating with the microprocessor, for instance a minitel whose keyboard provides interactive access to the management microprocessor.

According to a variant (not shown) of the distributing device referred to in the invention, DC motor reducer 29 is replaced by an inertia reducer (including a reducer and an inertia flywheel), coupled directly with shaft 27 which is then equipped with a thumb wheel switch and spring. Rollers 16 are then made larger and notched so that the cards do not drive the inertia reducer except over part of their periphery. With this device the encoding wheel will synchronize the reading speed whatever the speed of the card while the inertia of the flywheel will ensure the presentation of the next card through slot 7 by means of the accumulated energy during the exit of the previous card while the spring ensures limitation of any excess energy. A system of this type, although more delicate, makes a saving on the motor and its consumption.

Figure 5:
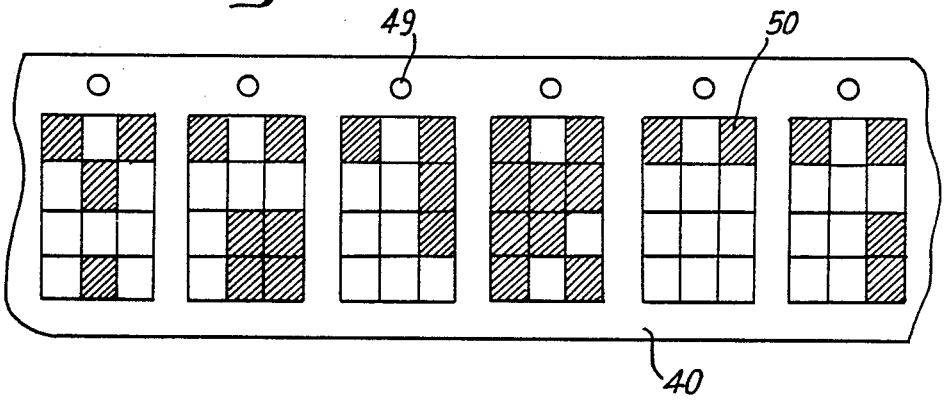
FIG. 5 is a plan view of a programming band designed for insertion into the distribution device and FIG. 6 is a plan view of a precoded score input band.
Figure 6:
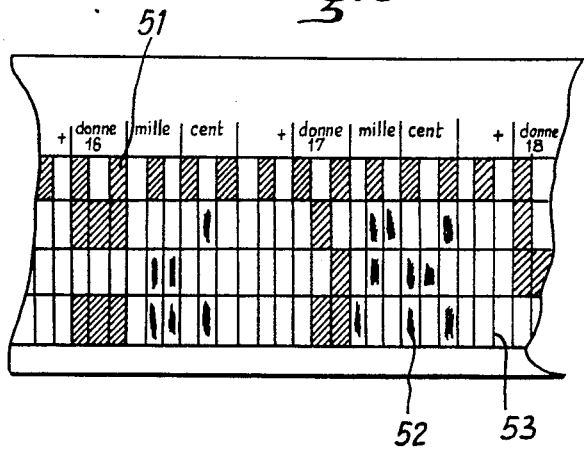

As shown in FIG. 5, encoding band 40 can be equipped with drive holes and thus reproduce code 50 of each card. However, because of the continuous feed and of the specialization involved, the codes may be narrower as shown in 51 of FIG. 6 and driven by friction. This narrowness of the band then makes it possible to read a code 52 entered into boxes 53 by the operators, with such codes being preprinted for instance in orange ink undetectable by the optical cells.

It will be understood that the above description is given for information only and is not limitative in any way and that constructive additions or modifications could be made without moving out of the scope of the invention as defined in the following claims.

We claim:

1. A playing card distributing device which comprises:

(a) a reception box for a pack of stacked cards to be distributed, (b) at least one roller carried by a shaft, protruding into the bottom of the reception box and on which a bottom card of the pack of cards presses, (c) a slot provided in a wall of the reception box, opposite said bottom card, (d) motor means driving in rotation said shaft for a limited period of time in the direction moving said bottom card through said slot, so that the bottom card projects partially through the slot to allow a user to grasp it manually, (e) free wheel means disposed between said shaft and said motor means, (f) first reading means disposed in the bottom of the reception box for reading information carried by the bottom card, (g) a memory for storing prearranged deals, (h) a visual display device indicating, by comparison between the information read on the bottom card and information stored in the memory concerning a deal in progress, to which player said bottom card should be dealt, and (i) second reading means disposed in the bottom of said reception box, in the vicinity of said slot, and connected to said motor means to automatically control, as soon as the bottom card has been fully removed from the slot, a limited rotation of the roller for unstacking a following card.

2. Distributing device according to claim 1 wherein the visual display device includes indicator lamps associated with a representation of the four cardinal points symbolizing the players to whom the cards should be distributed.

3. Distributing device according to claim 1 wherein the first reading means for reading the information marked on the cards to be dealt includes at least an optical detector placed in the bottom of the reception box in a location corresponding to the information marked on the card.

4. Distributing device according to claim 1 wherein said second reading means consists of a sensor means.

5. Distributing device according to claim 1 wherein said reception box includes a hinged cover inside of which is hinged a flap held by a spring to apply pressure to the pack of cards contained in said reception box, when said cover is in a closed position.

6. Distributing device according to claim 1 wherein said reception box incorporates a port for insertion of an encoding band bearing said prearranged deals, said band running opposite said first reading means for storage in the memory of inforamtion contained thereon, running on said roller to ensure its movement within the distributing device and exiting from the distributing device via said slot.

7. Playing card distribution assembly comprising a distributing device according to claim 1 and a card distribution management microprocessor permitting interfacing not only with the distributing device but also with other devices comprising a printer, a telematic terminal, a PC computer or an auxiliary memory

* * * * *